US009834988B1

(12) United States Patent
Arduna

(10) Patent No.: US 9,834,988 B1
(45) Date of Patent: Dec. 5, 2017

(54) LADDER PLATFORM ATTACHMENT

(71) Applicant: Arthur A. Arduna, Columbia, SC (US)

(72) Inventor: Arthur A. Arduna, Columbia, SC (US)

( * ) Notice: Subject to any disclaimer, the term of this patent is extended or adjusted under 35 U.S.C. 154(b) by 0 days.

(21) Appl. No.: 15/439,066

(22) Filed: Feb. 22, 2017

Related U.S. Application Data

(60) Provisional application No. 62/368,215, filed on Jul. 29, 2016.

(51) Int. Cl.
*E06C 7/16* (2006.01)
*E06C 7/14* (2006.01)

(52) U.S. Cl.
CPC ..... *E06C 7/165* (2013.01); *E06C 7/146* (2013.01); *E06C 7/16* (2013.01)

(58) Field of Classification Search
CPC ..... E06C 7/146; E06C 7/165
See application file for complete search history.

(56) References Cited

U.S. PATENT DOCUMENTS 806,162 A * 12/1905 Milbradt ..... E06C 7/165 182/120
2,597,756 A * 5/1952 Sitek ..... E06C 7/146 248/210
2,871,067 A 1/1959 Brogdon
3,731,840 A * 5/1973 Beutler ..... E06C 7/146 15/257.06
D248,777 S 8/1978 Spencer et al.
4,205,411 A * 6/1980 Cupp ..... B44D 3/126 15/257.06
4,401,187 A * 8/1983 Van Patten ..... E06C 7/143 182/121
5,276,943 A * 1/1994 Ludy ..... B44D 3/12 16/445
5,367,737 A * 11/1994 Vosbikian ..... A47L 13/52 15/144.1
5,402,910 A * 4/1995 Pilney ..... B44D 3/12 220/570
5,493,751 A * 2/1996 Misiukowiec ..... E06C 7/146 15/257.05
7,410,074 B1 * 8/2008 Brunning ..... B44D 3/126 15/257.06
7,861,826 B2 1/2011 Meyers et al.
8,366,061 B2 * 2/2013 Rose ..... B44D 3/14 15/257.06
2002/0100848 A1 * 8/2002 Ahl ..... E06C 7/146 248/211

* cited by examiner

*Primary Examiner* — Colleen M Chavchavadze
(74) *Attorney, Agent, or Firm* — Michael Rodriguez

(57) ABSTRACT

A portable ladder platform attachment, for increasing a person's safety when standing on a ladder, includes a platform having a surface, a forward edge, a rear edge, and opposing side edges, and a rod having a serpentine shape confined within a vertical plane above a centerline extending between the forward and rear edges of the platform. The rod has a first end coupled to the platform closer to the forward edge than to the rear edge, a midsection that extends above and substantially parallel to the surface of the platform along the centerline, and a second end shaped as a hook sized to fit closely about an upper rung of the ladder while the platform sits on a lower rung of the ladder.

19 Claims, 6 Drawing Sheets

LADDER PLATFORM ATTACHMENT

RELATED APPLICATION

This application claims the benefit of and priority to U.S. provisional application No. 62/368,215, filed Jul. 29, 2016, titled "Ladder Platform Attachment," the entirety of which application is incorporated by reference herein.

FIELD OF THE INVENTION

The invention relates generally to ladder platform attachments that increase a person's safety when the person works standing on a ladder.

BACKGROUND

When persons, particularly carpenters, painters, and persons of advanced age climb a ladder and install a ladder platform attachment thereon, an unsteady awkward physical stance may occur in the process. The risk of physical imbalance may also occur if both hands are concurrently required to adjust or shift the ladder platform from one rung level to another, thereby precluding gripping the ladder.

Prior art, such as U.S. Pat. No. 2,871,067 and U.S. Des. No. 248,777, force the user to repeatedly assume an unsteady physical stance when positioning the platform in order to stand on it; and later in order to descend, to remove the residual obstacle the platform has become. In each case the platform must be manipulated while the user is standing on a bent-knee leg on the next higher rung above the positioned platform and must stretch downward twelve inches to shift the platform by using one foot to do so. It is a risky task for an elderly person or one with knee problems!

The risk of physical imbalance may also occur if both hands are concurrently required to adjust elements of a ladder attachment, thereby precluding the availability of even one hand to grip the ladder to maintain physical balance.

Additionally, the pain produced in the arches of feet whenever a narrow ladder rung or the extent of the rear end of the platform fails to adequately support the heels of the feet may produce risk of distraction.

SUMMARY

All examples and features mentioned below, in the Summary, the Description, and the Claims, can be combined in any technically possible way.

In one aspect, a portable ladder platform attachment, for increasing a person's safety when standing on a ladder, comprises a platform having a surface, a forward edge, a rear edge, and opposing side edges, and a rod having a serpentine shape confined within a vertical plane above a centerline extending between the forward and rear edges of the platform. The rod has a first end coupled to the platform closer to the forward edge than to the rear edge, a midsection that extends above and substantially parallel to the surface of the platform along the centerline, and a second end shaped as a hook sized to fit closely about an upper rung of the ladder while the platform sits on a lower rung of the ladder.

In another aspect, a ladder platform attachment, for increasing a person's safety when standing on a ladder, comprises a platform having a surface, a forward edge, and a rearward edge, and a lone rod having a serpentine shape confined within a vertical plane above a centerline extending between the forward and rear edges of the platform. The rod has a first end coupled to the platform near the forward edge and a second end shaped as a hook sized to fit closely about a rung of the ladder. The rod having a vertical extent that is substantially equal to a vertical distance between an upper rung and an adjacent lower rung of the ladder.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention. In the following description, like reference characters designate like or corresponding parts or points throughout the views.

DETAILED DESCRIPTION

Figure 1:
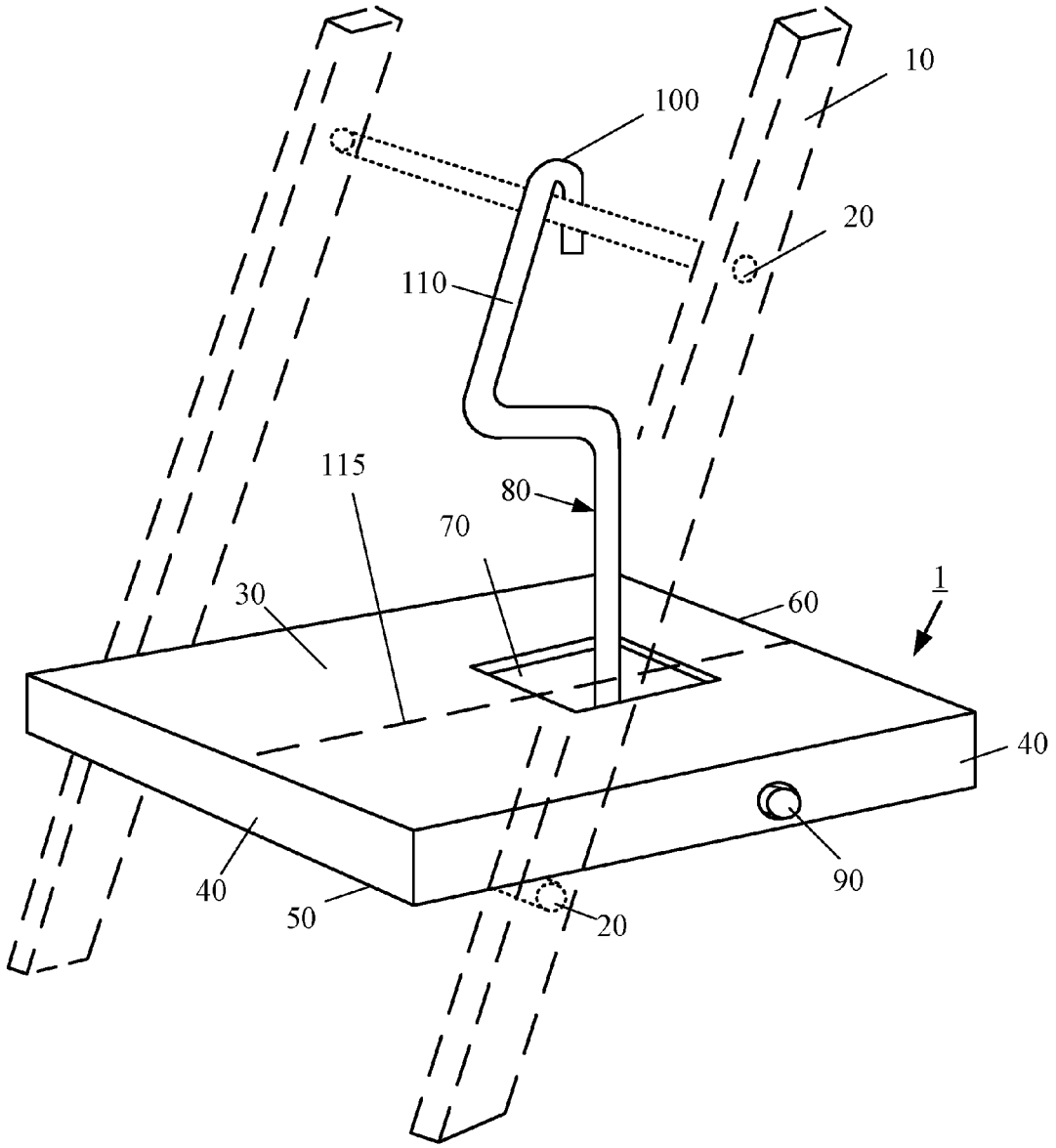
FIG. 1 is a perspective view of an embodiment of a ladder platform attachment in operative use upon the ladder.

Ladder platform attachments described herein may comprise a platform coupled to a crossbar that is solidly connected to one end of a rod, while the other end of the rod is shaped as a hook whereby the attachment may be hung on a rung of a ladder. The design of a ladder platform attachment is based on the perception that when a person stands on a platform, the feet are not positioned to rest in side by side contact, but instead rest a distance apart to maintain physical stability. This separation affords a structure, wherein a serpentine shaped rod element may be confined within a plane vertical above the centerline running the length of the platform, as the basis for a ladder platform structure that resolves the enumerated risks.

To accomplish the aforementioned advantages, the ladder platform attachment comprises a platform hinged to a crossbar that is joined to one end of a rod. The ends of the crossbar are inserted in opposing swivel ports in two parallel flanges attached to the platform. The rod's other end is shaped into a hook for hanging the ladder platform attachment on a ladder rung. In general, the shape of the hook complements the shape of the rungs of the particular commercial brand of ladder for which the ladder platform attachment is designed. The shape of the rod can be confined within a plane vertical above the centerline running a length of the platform, from front to rear. In one embodiment, the rod rises through an aperture in the forward end of the platform and then curves toward the rear end while parallel to the platform's upper surface, then curves sharply upward when past the overshadowing rung to hang thereon with its hook.

Thereby, when the ladder platform attachment is hung on the ladder, between two adjacent ladder rungs, the crossbar attached to the rod supports the forward end of the platform, and, in the process of its installation on the ladder, the platform lifts slightly as it slides over a rung, and then automatically, by it weight, shifts on the crossbar hinge, and thereby settles its rear end on the lower rung. The width of the ladder platform attachment depends upon the particular commercial brand of ladder for which the ladder platform attachment is designed. Simultaneously, the platform also protrudes sufficiently beyond the lower rung to support for the soles' heels, without becoming an obstacle to ascending or descending the ladder, as occurs in the cited prior art.

The portion of the rod, just below the level of the upper rung that it hangs on, serves as a carrying handle to grip and carry the attachment with one hand, while the other hand is free to grip the ladder.

When a person transits the ladder, the rod with a hook at its end also serves as an extension for reaching up and hooking momentarily onto a ladder rung, thereby assuring two-handed control; concomitantly as one hand is free to shift its grip along the length of the ladder, the other hand gripping the rod alternatively shifts the rod's hook from rung to rung to hang thereon to maintain physical balance.

Advantages that the ladder platform attachment may provide include, but are not limited to: not imposing an unsteady physical stance of the user; providing a ladder platform attachment that is simple to attach to any section of the ladder, detachable, and easy to grip and safely shift from one height to another; leaving one hand of the user available to grip the ladder and maintain balance whenever the other hand must grip the ladder platform attachment to carry it; providing a ladder platform attachment that automatically settles on a rung for support at the moment it is installed on the ladder; providing a ladder platform attachment that is simple in design, inexpensive to manufacture and durable in construction. Other advantages include: having a platform sized to fit between the ladder side supports holding the ladder rungs; and having the position and size of the platform to fully support the soles of the feet. Embodiments of the ladder platform may include one or any combination of the following features: the platform, crossbar, and a rod may all be made of metal or plastic or a combination thereof; the platform may be coupled to one end of a rod by a hinge; the platform may be solidly joined to one end of the rod.

FIG. 1 shows a view of one embodiment of a ladder platform attachment 1 coupled to a ladder 10 (shown in phantom) with ladder rungs 20 that serve to support the attachment. The ladder platform attachment 1 includes a platform 30 with flanges 40 along the side edges of the platform, and, optionally, along all four side edges. The platform 30 has a rear end 50, a front end 60, and an aperture 70. A rod 80 extends through the aperture 70. A crossbar 90 projects through two opposing flanges 40 (only one end of the crossbar is shown). One end of the rod 80 is coupled to the crossbar 90 (obscured by the platform); the other end of the rod 80 has hook 100. The hook 100 serves to hang the ladder platform attachment onto a ladder rung 20. In general, the size and shape of the crook of the hook is designed to accommodate the particular size and shape of the ladder rung. A straight section 110 of the rod serves as a carrying handle to grip and carry the ladder platform attachment. The serpentine shape of the rod is confined within a vertical plane above a centerline 115 extending between the forward and rear edges of the platform.

Figure 2:
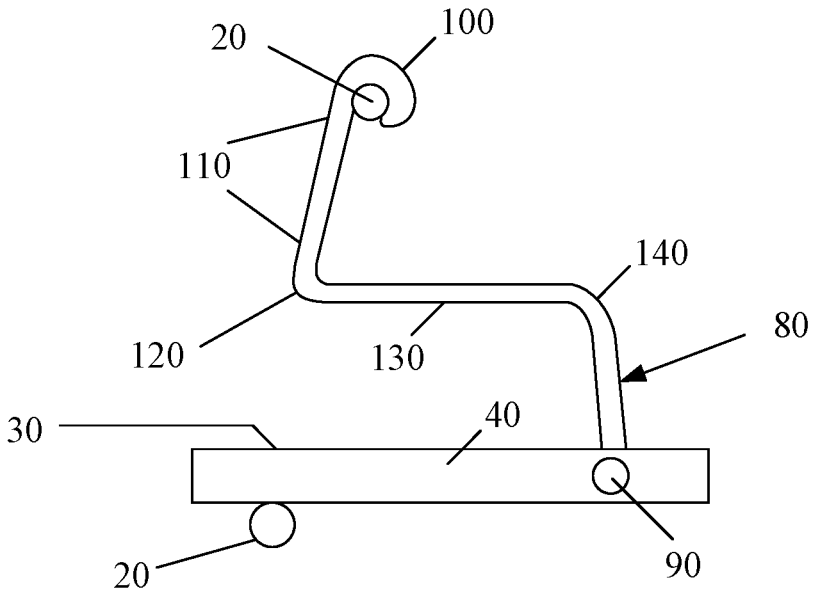
FIG. 2 is a side view of the ladder platform attachment with a rod and a crossbar.

FIG. 2 shows a side view of the ladder platform attachment 1. The hook 100 of the ladder platform attachment is curled about one upper rung 20 of the ladder. The rear end 50 of the platform 30 sits on a second, adjacent lower rung 20. The rod 80 has a hanger-like shape, having the straight section 110 that extends from the hook 100, a first bend 120 into a second straight midsection 130 that runs above and generally parallel to the platform 30, and a second bend 140 that extends the rod towards the platform 30. The rod 80 is joined to the crossbar 90, which projects through the sides of the flanges 40.

Figure 3:
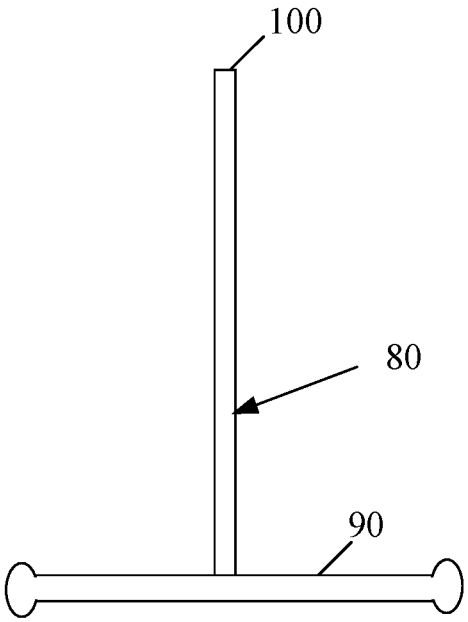
FIG. 3 is a view of the rod solidly attached to the crossbar.

FIG. 3 shows an end view of the ladder platform attachment 1 with the platform removed to show the rod 80 joined at one end to a mid-point (approximately) of the crossbar 90 and having the hook 100 at the opposite end.

Figure 4:
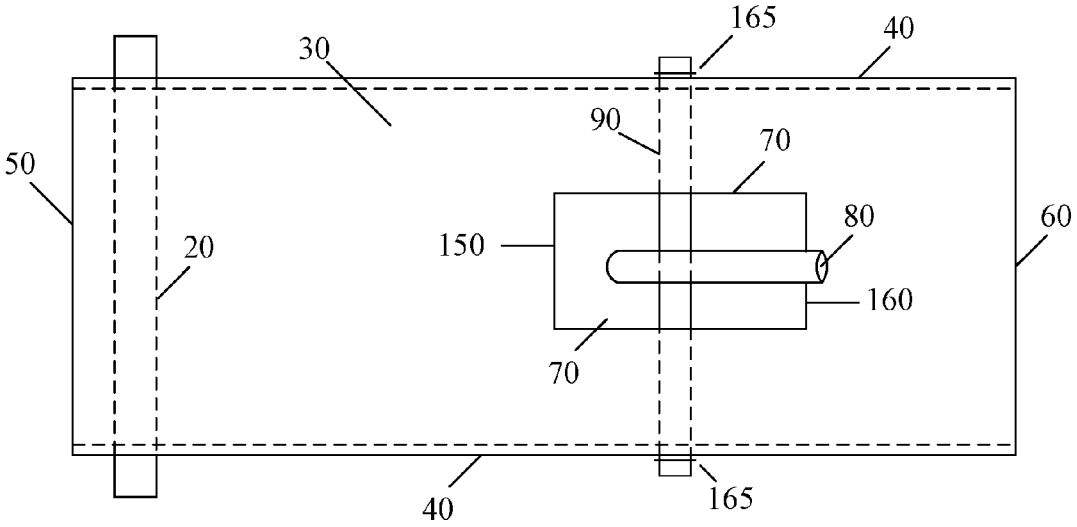
FIG. 4 is a top view of the ladder platform attachment.

FIG. 4 shows a top view of the platform 30, side flanges 40, shaft opening 70 in the platform, a portion of the rod 80, the cross-bar 90, which passes through an opening in the rod, and a ladder rung 20 near a rear edge 50 of the platform. While the vertical distance between sequential (i.e., adjacent, consecutive) rungs of a ladder is usually twelve inches, that distance may vary slightly depending on the angle of the ladder as it inclines against a supporting wall. To compensate for that slight variation, the hinge permits the platform 30 to settle in full contact onto the lower of two sequential ladder rungs, since the rod 80 may swivel in an arc. The ability of the rod to swivel can arise because the rod 80 is fused to a cross-bar 90 that can rotate freely within the side flanges 40, or because the rod is not fixed to the cross-bar, which may or may not be fused to the side flanges, and can thus rotate freely about the cross-bar. That arc of free movement of the rod 80 is only limited at its extreme points by the rear edge 150 and forward edge 160 of the platform's shaft opening 70 through which the rod protrudes. Thereby the hinge provides a portion of the platform freedom of movement to, by its own weight, settle its rear end 50 via its side flanges 40 onto a ladder rung 20 for support. The cross-bar 90 holds up the front end 60 of the platform. Stainless steel side-mount rings 165 snap into respective grooves (not shown) on the shaft of the cross-bar 90 to secure the cross-bar 90 in its position. Washers (not shown) may be disposed between the flanges 40 and each side-mount ring 165.

Figure 5:
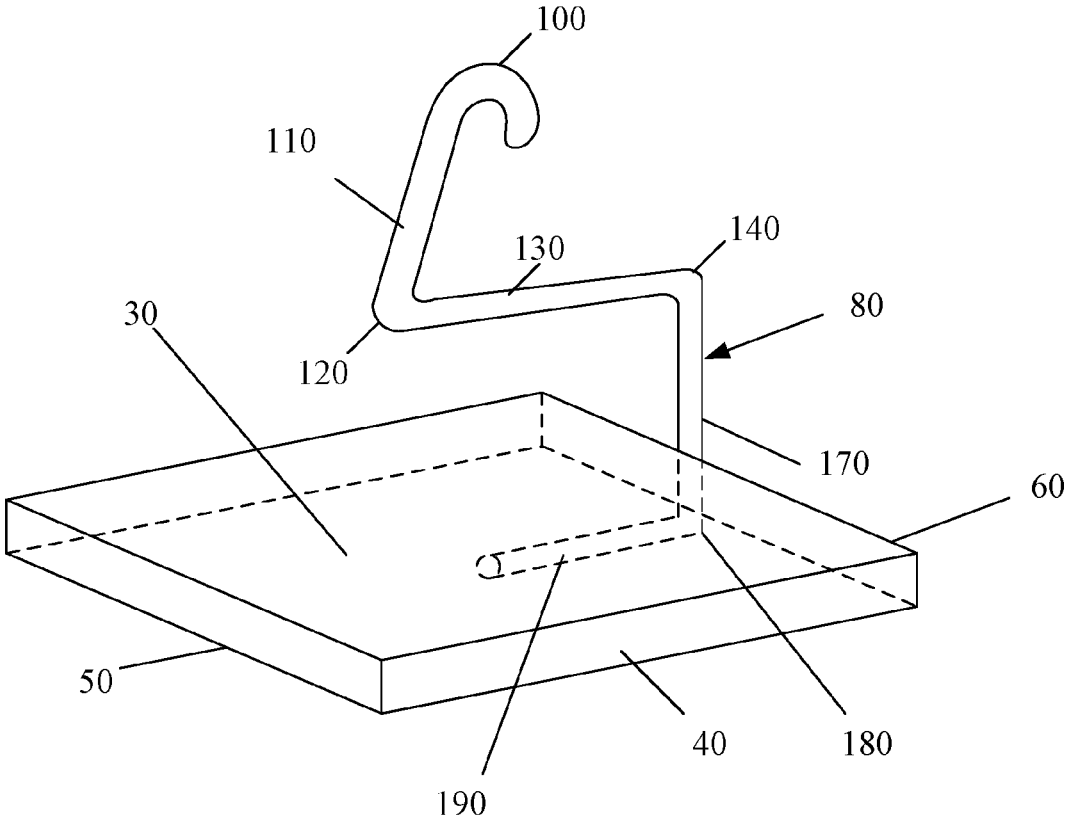
FIG. 5 is a perspective view of another embodiment of a ladder platform attachment.

FIG. 5 shows another embodiment of a ladder platform attachment 1, wherein the rod 80 has the hook 100, a straight section 110, first bend 120, second straight section 130, a second bend 140, and a second straight section 170, like the rod shown in FIGS. 1-3. The second straight section 177 extends past the front edge 60 of the platform 30. The rod 80 further includes a third bend 180 that turns into a third straight section 190 that runs along the underside of the platform 30.

Figure 6:
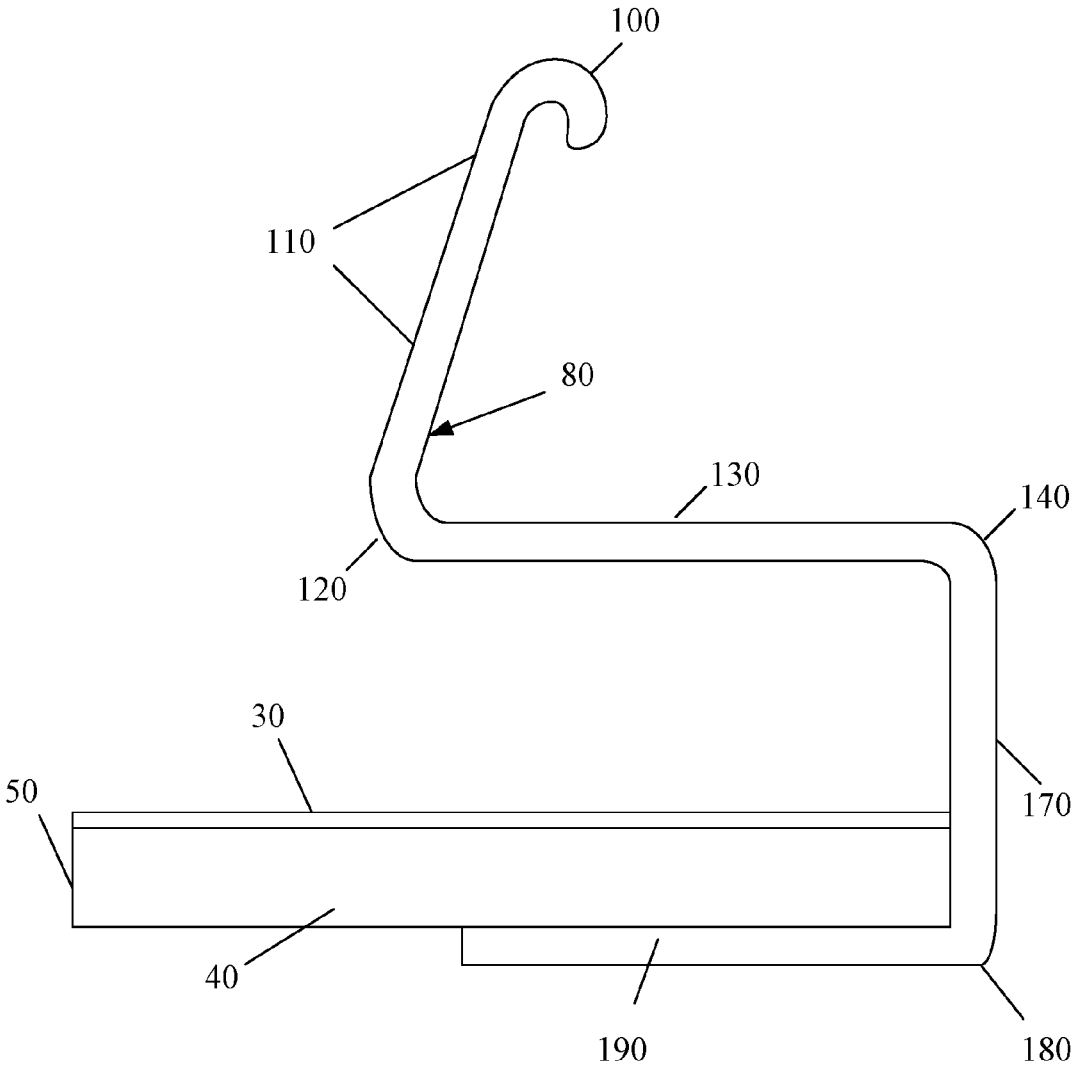
FIG. 6 is a side of the ladder platform attachment of FIG. 5.

FIG. 6 shows a side view of the embodiment of the ladder platform attachment 1 of FIG. 5, with the rod 80 connected (e.g., fused, welded) to the underside of the platform 30.

Figure 7:
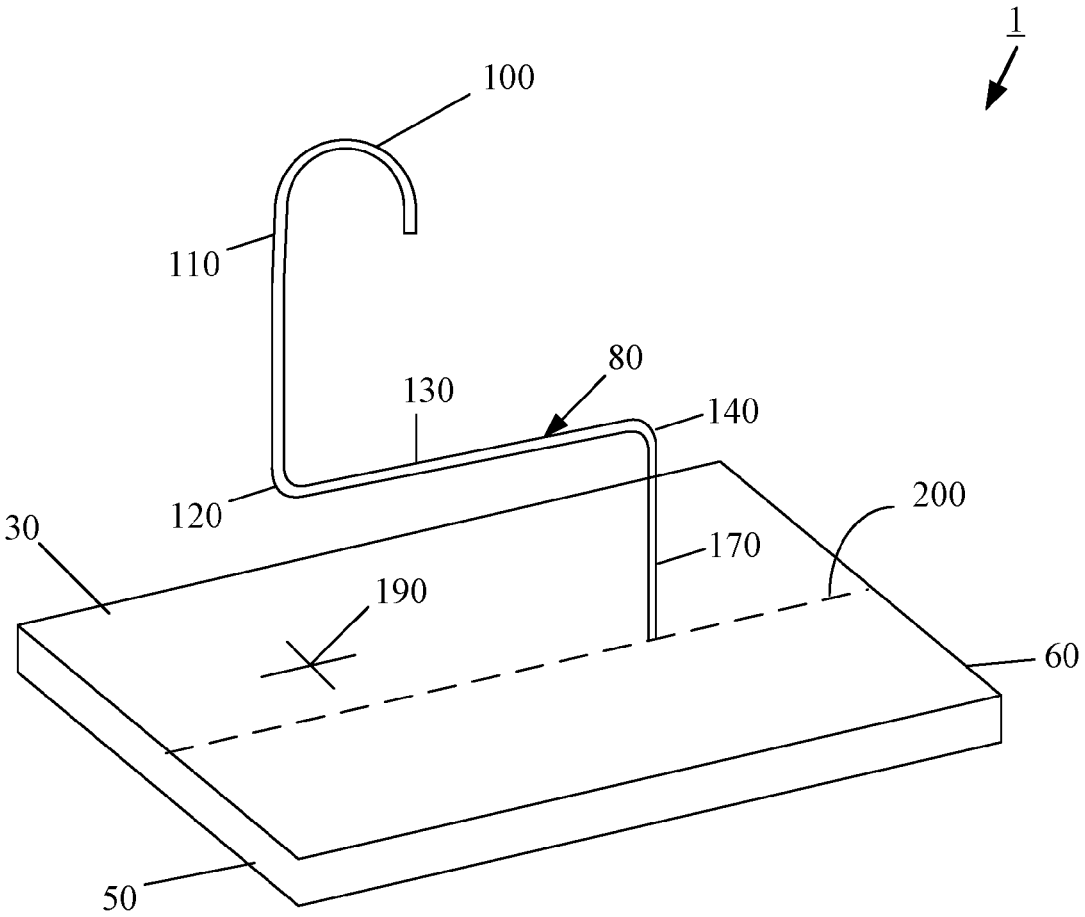
FIG. 7 is a perspective view of another embodiment of a ladder platform attachment.

FIG. 7 shows another embodiment of a ladder platform attachment 1, with the rod 80 connected to the top surface 190 of the platform 30, for example, by welding or by a hinge. The serpentine shape of the rod 80 is confined within a vertical plane above a centerline 200 extending between the forward and rear edges of the platform.

It is to be understood that terms such as "forward," "back," "rear," "vertical," "top", "bottom", "above," "beneath," "below," and the like are terms to facilitate the description and are not to be construed as limitations of the aforementioned principles. Further, while these principles have been described in conjunction with a number of embodiments, it is evident that many alternatives, modifications, and variations would be or are apparent to those of ordinary skill in the applicable arts. References to "one embodiment" or "an embodiment" or "another embodiment" means that a particular, feature, structure or characteristic described in connection with the embodiment is included in at least one embodiment described herein. A reference to a particular embodiment within the specification do not necessarily all refer to the same embodiment. The features illustrated or described in connection with one exemplary embodiment may be combined with the features of other embodiments. Accordingly, it is intended to embrace all such alternatives, modifications, equivalents, and variations that are within the spirit and scope of the principles described herein.

What is claimed is:

1. A portable ladder platform attachment for increasing a person's safety when standing on a ladder, comprising:

a platform having a surface, a forward edge, a rear edge, and opposing side edges; and a rod having a serpentine shape confined within a vertical plane above a centerline extending between the forward and rear edges of the platform, the rod having a first end coupled to the platform closer to the forward edge than to the rear edge, a midsection that extends above and substantially parallel to the surface of the platform along the centerline, and a second end shaped as a hook, the shape of the hook being complementary to an upper rung of the ladder from which the hook hangs while the platform sits on a lower rung of the ladder.

2. The ladder platform attachment of claim 1, wherein the surface of the platform has an opening through which a section of the rod extends, and further comprising a crossbar disposed crosswise below the surface of the platform with opposite ends of the crossbar being coupled to the opposing side edges of the platform, and wherein the first end of the rod is coupled to the crossbar.

3. The ladder platform attachment of claim 2, wherein the crossbar is joined to the opposing side edges of the platform.

4. The ladder platform attachment of claim 2, wherein the crossbar is rotatably joined to the side edges of the platform.

5. The ladder platform attachment of claim 2, wherein the platform, crossbar, and rod are made of metal.

6. The ladder platform attachment of claim 2, wherein the platform, crossbar, and rod are made of plastic.

7. The ladder platform attachment of claim 2, wherein at least one of the platform, crossbar, and rod is made of plastic, and a remainder of the platform, crossbar, and rod is made of metal.

8. The ladder platform attachment of claim 1, wherein a crook of the hook-shaped second end of the rod faces the forward edge of the platform.

9. The ladder platform attachment of claim 1, the first end of the rod is coupled to the surface of the platform.

10. The ladder platform attachment of claim 1, wherein the platform has a width substantially equal to a width of a rung of the ladder.

11. The ladder platform attachment of claim 1, wherein the rod has a vertical extent that is substantially equal to a vertical distance between adjacent rungs of the ladder.

12. The ladder platform attachment of claim 1, wherein the rear edge of the platform extends beyond the rung on which the platform sits.

13. A ladder platform attachment for increasing a person's safety when standing on a ladder, comprising:

a platform having a surface configured to support a person standing thereon, a forward edge, and a rearward edge; and a rod having a serpentine shape confined within a vertical plane above a centerline extending between the forward edge and the rearward edge of the platform, the rod having a first end coupled to the platform near the forward edge and a second end shaped as a hook, the shape of the hook being complementary to an upper rung of the ladder from which the hook hangs while the platform at the rearward edge sits on an adjacent lower rung of the ladder, the rod having a vertical extent that is substantially equal to a vertical distance between the upper rung and the adjacent lower rung of the ladder.

14. The ladder platform attachment of claim 13, wherein the surface of the platform has an opening through which the rod extends, and further comprising a crossbar disposed crosswise below the surface of the platform, with opposite ends of the crossbar being coupled to opposing side edges of the platform, and wherein the first end of the rod is coupled to the crossbar.

15. The ladder platform attachment of claim 13, wherein the rod extends past the forward edge of the platform and bends beneath and supports the platform.

16. The ladder platform attachment of claim 13, wherein a section of the rod extends parallel to the platform along the centerline.

17. The ladder platform attachment of claim 13, the first end of the rod is coupled to the surface of the platform.

18. The ladder platform attachment of claim 13, wherein the platform has a width substantially equal to a width of a rung of the ladder.

19. The ladder platform attachment of claim 13, wherein the rearward edge of the platform extends outward beyond the lower rung on which the platform sits.

* * * * *